US005517287A

United States Patent [19]

Rodriguez et al.

[11] Patent Number: 5,517,287

[45] Date of Patent: May 14, 1996

[54] DONOR ROLLS WITH INTERCONNECTED ELECTRODES

[75] Inventors: Alberto Rodriguez, Walworth; Heiko Rommelmann, Webster, both of N.Y.

[73] Assignee: Xerox Corporation, Stamford, Conn.

[21] Appl. No.: 376,585

[22] Filed: Jan. 23, 1995

[51] Int. Cl.[6] ..... G03G 15/06

[52] U.S. Cl. ..... 355/259; 355/261; 355/262; 118/648; 118/651

[58] Field of Search ..... 355/259, 245, 355/261, 262, 265, 247–249; 118/647, 648, 651

[56] References Cited

U.S. PATENT DOCUMENTS

| | | | |
|---|---|---|---|
| 3,980,541 | 9/1976 | Aine | 204/186 |
| 3,996,892 | 12/1976 | Parker et al. | 118/658 |
| 4,868,600 | 9/1989 | Hays et al. | 355/259 |
| 5,172,170 | 12/1992 | Hays | 355/259 |
| 5,268,259 | 12/1993 | Sypula | 430/311 |
| 5,289,240 | 2/1994 | Wayman | 355/259 |

*Primary Examiner*—Matthew S. Smith
*Attorney, Agent, or Firm*—John S. Wagley

[57] ABSTRACT

An apparatus for transporting marking particles is provided. The apparatus includes a donor roll and an electrode member. The electrode member includes a plurality of electrical conductors mounted on the surface of donor roll with adjacent electrical conductors being spaced from one another. The electrode member further includes a connecting member fixedly secured to the donor roll. The connecting member electrically interconnects at least two electrical conductors.

16 Claims, 4 Drawing Sheets

DONOR ROLLS WITH INTERCONNECTED ELECTRODES

The present invention relates to a developer apparatus for electrophotographic printing. More specifically, the invention relates to a donor roll as part of a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent to the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al., which is hereby incorporated by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

It has been found that for some toner materials, the tensioned electrically biased wires in self-spaced contact with the donor roll tend to vibrate which causes non-uniform solid area development. Furthermore, there is a possibility that debris can momentarily lodge on the wire to cause streaking. Thus, it would appear to be advantageous to replace the externally located electrode wires with electrodes integral to the donor roll.

In U.S. Pat. No. 5,172,170 to Hays et al., there is disclosed an apparatus for developing a latent image recorded on a surface, including a housing defining a chamber storing at least a supply of toner therein a moving donor member spaced from the surface and adapted to transport toner from the chamber of said housing to a development zone adjacent the surface, and an electrode member integral with the donor member and adapted to move therewith. The electrode member is electrically biased to detach toner from said donor member to form a cloud of toner in the space between the electrode member and the surface with toner developing the latent image. The biasing of the electrodes is typically accomplished by using a conductive brush which is placed in a stationary position in contact with the electrodes on the periphery of the donor member. U.S. Pat. No. 5,172,170 is herein incorporated by reference. The conductive brush is electrically connected with a electrically biasing source. Typically only the electrodes in the nip between the donor member and the developing surface are electrically biased. As the donor member rotates the electrodes that now are in the nip need to contact the brush. Every time the brush begins and ends contact with an individual biased electrode electrical stress is induced into the system. Contact is established between the brush and the electrode as the electrode touches the brush as the donor roll rotates and contact with that electrode ends prior to the next electrode establishing contact with the brush. The contact of the electrode with the brush results in sparks and electrical noise. The contact area between the brush and the electrode is very small exacerbating the spark and noise problem. The small contact area and the spark problem lead to abrasion at the brush electrode interface. The noise problem can lead to machine reliability problems and copy quality problems.

The following disclosures related to scavangeless and electroded rolls may be relevant to various aspects of the present invention:

U.S. Pat. No. 5,289,240

Patentee: Wayman

Issue Date: Feb. 22, 1994

U.S. Pat. No. 5,268,259

Patentee: Sypula

Issue Date: Dec. 7, 1993

U.S. Pat. No. 5,172,170

Patentee: Hays et al.

Issue Date: Dec. 15, 1992

U.S. Pat. No. 4,868,600

Patentee: Hays et al.

Issue Date: Sept. 19, 1989

U.S. Pat. No. 3,996,892

Patentee: Parker et al.

Issue Date: Dec. 14, 1976

U.S. Pat. No. 3,980,541

Patentee: Aine

Issue Date: Sept. 14, 1976

U.S. Pat. No. 5,289,240 discloses a donor roll which has two distinct set of electrodes along the periphery of the donor roll. The roll has a first set of electrodes that extend axially the length of the roll, are interconnected to each other and contact the filaments of a brush. The roll also has a second set of electrodes that extend axially the length of the roll, are interconnected to each other and do not contact the brush.

U.S. Pat. No. 5,268,259 discloses a process for preparing a toner donor roll which has an integral electrode pattern. The process includes coating a cylindrical insulating member with a photoresistive surface, pattern exposing the photoresistive surface to light to form an electrode pattern and depositing conductive metal on the portion of the member exposed to light to form the electrode pattern.

U.S. Pat. No. 5,172,170 discloses a donor roll with a plurality of electrical conductors spaced from one another with one of the conductors located in one of the grooves in the donor roll. A dielectric layer is disposed in at least the grooves of the roll interposed between the roll and the conductors and may cover the region between the grooves. The dielectric layer may be fabricated of anodized aluminum or a polymer and may be applied by spraying, dipping or powder spraying. The roll is made from a conductive material such as aluminum and the dielectric layer is disposed about the circumferential surface of the roll between adjacent grooves. The conductive material is applied to the grooves by a coater to form the electrical conductors. A charge relaxable layer is applied over the donor roll surface.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

U.S. Pat. No. 3,996,892 discloses a donor roll having an electrically insulative core made of a phenloic resin. The donor roll core is coated with conductive rubber doped with carbon black. Conductor strips are formed on the rubber by a copper cladding process followed by a photo-resist-type etching technique.

U.S. Pat. No. 3,980,541 discloses composite electrode structures including mutually opposed electrodes spaced apart to define a fluid treatment region. Resistive electrodes serve to localize the effects of electrical shorts between electrodes. Non-uniform sheet and filamentary electrodes are disclosed for producing a substantially non uniform electric field.

SUMMARY OF THE INVENTION

According to the present invention, there is provided an apparatus for transporting marking particles. The apparatus includes a donor roll and an electrode member. The electrode member includes a plurality of electrical conductors mounted on the surface of donor roll with adjacent electrical conductors being spaced from one another. The electrode member further includes a connecting member fixedly secured to the donor roll. The connecting member electrically interconnects at least two electrical conductors.

According to the present invention, there is also provided a developer unit for developing a latent image recorded on an image receiving member to form a developed image. The developer unit includes a donor roll and an electrode member. The electrode member includes a plurality of electrical conductors mounted on the surface of donor roll with adjacent electrical conductors being spaced from one another. The electrode member further includes a connecting member fixedly secured to the donor roll. The connecting member electrically interconnects at least two electrical conductors.

According to the present invention, there is further provided an electrophotographic printing machine of the type having a developer unit adapted to develop with marking particles an electrostatic latent image recorded on a photoconductive member. The machines includes a donor roll and an electrode member. The electrode member includes a plurality of electrical conductors mounted on the surface of donor roll with adjacent electrical conductors being spaced from one another. The electrode member further includes a connecting member fixedly secured to the donor roll. The connecting member electrically interconnects at least two electrical conductors.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
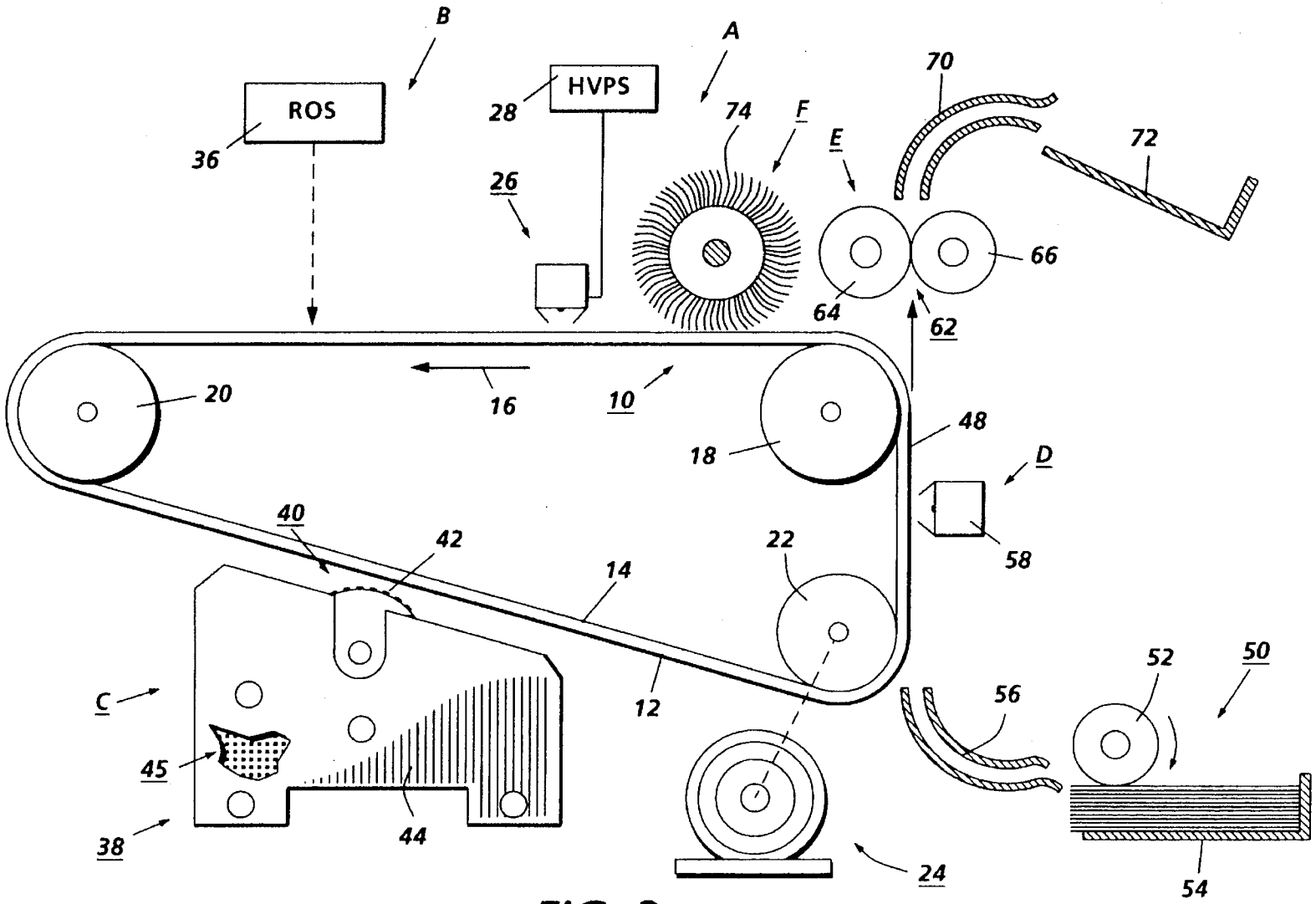
FIG. 3 is a schematic elevational view of development unit incorporating the dual commutation segmented donor roll for use in the printing machine of FIG. 1.

Referring initially to FIG. 3, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, ROS 36 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 3. At development station C, a development system 38, develops the latent image recorded on the photoconductive surface. Preferably, development system 38 includes a donor roll or roller 40 and electrical conductors in the form of electrode wires or electrodes 42 positioned on the periphery of donor roll 40. Electrodes 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material 45. The developer material is a two component developer material of at least magnetic carrier granules having toner particles adhering triboelectrically thereto. A transport roll or roller 46 disposed interiorly of the chamber of housing 44 conveys the developer material to the donor roll 40. The transport roll 46 is electrically biased relative to the donor roll 40 so that the toner particles are attracted from the transport roller to the donor roller.

Again referring to FIG. 3, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 4:
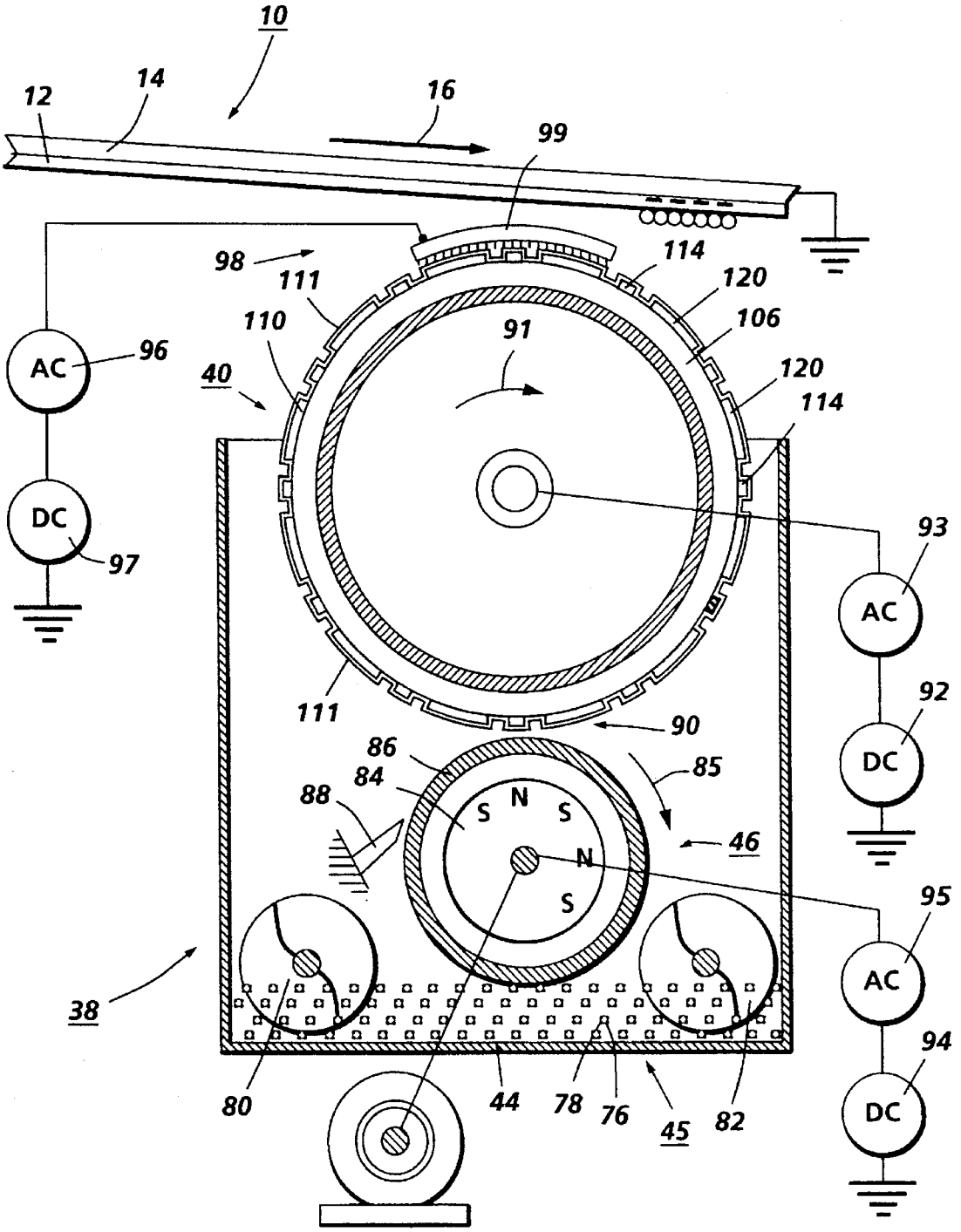
FIG. 4 is a schematic elevational view of an illustrative printing machine incorporating the dual commutation segmented donor roll of the present invention.

Referring now to FIG. 4, there is shown development system 38 in greater detail. Housing 44 defines the chamber for storing the supply of developer material 45 therein. The developer material 45 includes carrier granules 76 having toner particles 78 adhering triboelectrically thereto. Positioned in the bottom of housing 44 is are horizontal augers 80 and 82 which distributes developer material 45 uniformly along the length of transport roll 46 in the chamber of housing 44.

Transport roll 46 comprises a stationary multi-pole magnet 84 having a closely spaced sleeve 86 of non-magnetic material, preferably aluminum, designed to be rotated about the magnet 84 in a direction indicated by arrow 85. Because the developer material 45 includes magnetic carrier granules 76, the effect of the sleeve 86 rotating through stationary magnetic fields is to cause developer material 45 to be attracted to the exterior of the sleeve 86. A doctor blade 88 meters the quantity of developer adhering to sleeve 86 as it rotates to a loading zone 90, the nip between transport roll 46 and donor roll 40.

The donor roll 40 is kept at a specific voltage, by a direct current, DC. voltage source 92 to attract a layer of toner particles 78 from transport roll 46 to donor roll 40 in the loading zone 90.

An alternating current, AC, voltage source 93 may also be connected to the donor roll 40. The effect of the AC electrical field applied along the donor roller in loading zone or nip 90 is to loosen the toner particles 78 from their adhesive and triboelectric bonds to the carrier particles 76. Either the whole of the donor roll 40, or at least a peripheral layer thereof, is preferably of material which has low electrical conductivity. The material must be sufficiently conductive to prevent any build-up of electric charge with time, and yet its conductivity must be sufficiently low to form a blocking layer to prevent shorting or arcing of the magnetic brush to the donor roller.

Transport roll 46 is biased by both a DC voltage source 94 and an AC voltage source 95. The effect of the DC electrical field is to enhance the attraction of developer material to sleeve 86. It is believed that the effect of the AC electrical field applied along the transport roller in loading zone 90 is to loosen the toner particles from their adhesive and triboelectric bonds to the carrier particles.

While the development system 38 as shown in FIG. 4 utilizes donor roller DC voltage source 92 and AC voltage source 93 as well as transport roller DC voltage source 94 and AC voltage source 95, the invention may be practiced, with merely DC voltage source 92 on the donor roller.

It has been found that a value of up to 200 $V_{rms}$ is sufficient for the output of transport roll AC voltage source 95 for the desired level of reload efficiency of toner particles to be achieved. The actual value can be adjusted empirically. In theory, the value can be any value to a maximum voltage of about 400 $V_{rms}$. The source should be at a frequency of about 2 kHz. If the frequency is too low, e.g. less than 200 Hz, banding will appear on the copies. If the frequency is too high, e.g. more than 15 kHz, the system would probably work but the electronics may become expensive because of capacitive loading losses.

The donor roll 40 includes the electrodes 42 in the form of electrical conductors positioned about the peripheral circumferential surface thereof. The electrodes are preferably positioned on the circumferential surface and may be applied by any suitable process such as plating, overcoating or silk screening. It should be appreciated that the electrodes may alternatively be located in grooves (not shown) formed in the periphery of the roll 40. The electrical conductors 42 are substantially spaced from one another and insulated from the body of donor roll 40 which may be electrically conductive. Donor roll 40 rotates in the direction of arrow 91. The relative voltages between donor roll 40 and magnetic roll 46 are selected to provide efficient loading of toner on donor roll 40 from the carrier granules adhering to magnetic roll 46. Furthermore, reloading of developer material on magnetic roll 46 is also enhanced. In the development zone, AC and DC electrode voltage sources 96 and 97, respectively, electrically bias electrical conductors 42 to a DC voltage having an AC voltage superimposed thereon.

Electrode voltage sources 96 and 97 are in wiping contact with isolated electrodes 42. As donor roll 40 rotates in the direction of arrow 91, successive electrodes 42 advance into development nip 98, the nip between the donor roll 40 and the photoreceptor belt 10, and are electrically biased by voltage sources 96 and 97. As shown in FIG. 4, wiping brush 99 contacts isolated electrodes 42 in the development nip 98 and is electrically connected to electrode voltage sources 96 and 97. In this way, isolated electrodes or electrical conductors 42 advance into development nip 98 as donor roll 40 rotates in the direction of arrow 91. Isolated electrodes, i.e. electrical conductors 42, in development nip 98, contact wiping brush 99 and are electrically biased by electrode voltage sources 96 and 97. In this way, an AC voltage difference is applied between the isolated electrical conductors and the donor roll detaching toner from the donor roll and forming a toner powder cloud.

Figures 1, 1A:
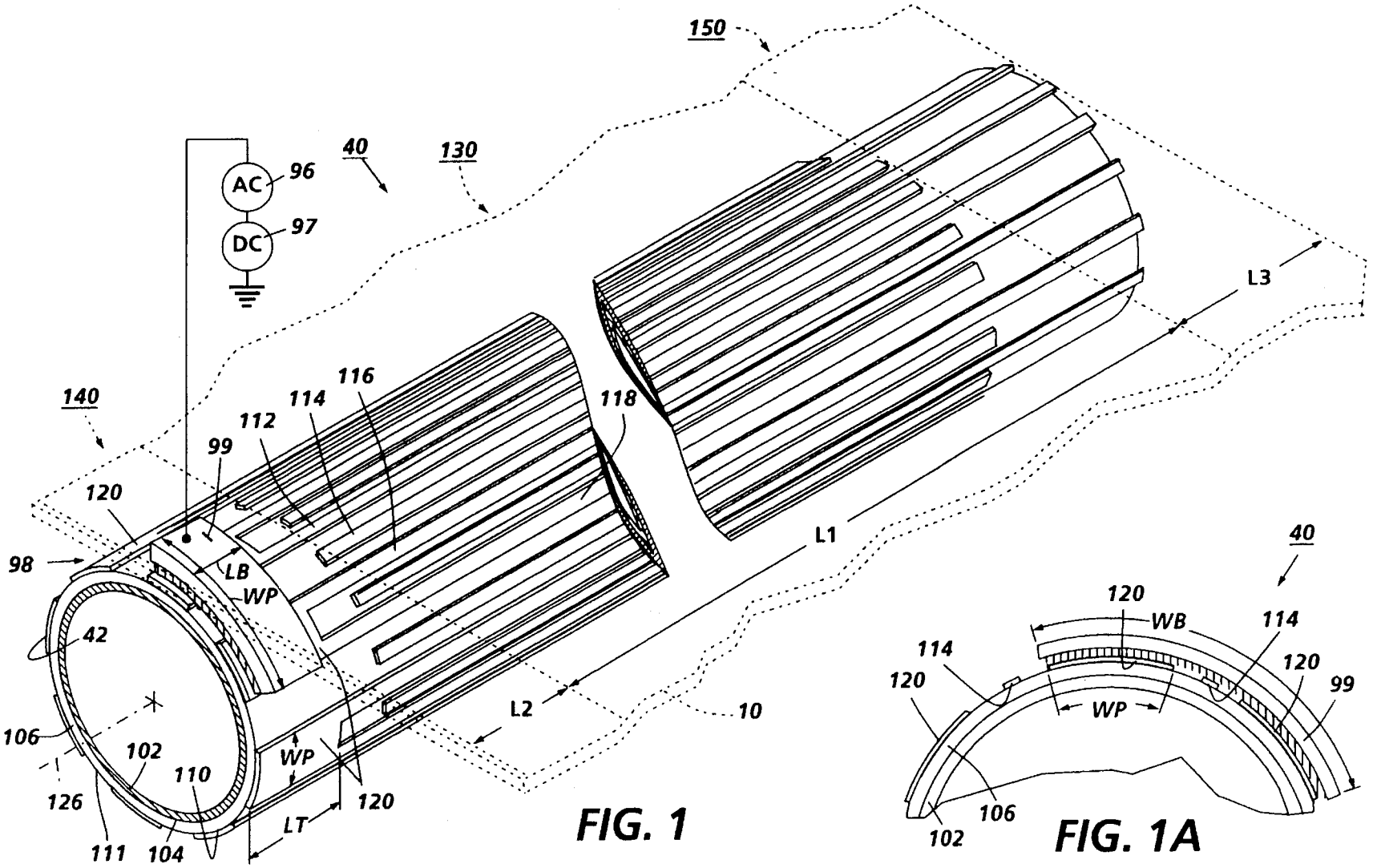
FIG. 1 is a fragmentary perspective view of the dual commutation segment/ed donor roll of the present invention.
FIG. 1A is a partial plan view of the brush contacting the pads of the dual commutation segmented donor roll of the present invention.

According to the present invention and referring to FIG. 1, donor roll 40 is shown. The photoconductive member in the form of the photoreceptor belt 10 is shown in phantom above the donor roll 40. The donor roll 40 is may be made of a core 102 such as in the form of a hollow tube. The core 102 may be made of any suitable durable material which may be conductive, semi-conductive or non-conductive. If the core 102 is made of a conductive core, the core is typically made of aluminum. It should be appreciated, however, that the core 102 may be made of a solid cylinder and be made of other conductive material such as steel, other metals, or a plastic material with carbon or other conductive additives.

Extending outwardly from periphery 104 of the core 102 is a dielectric layer 106. The dielectric layer 106 may be anodized aluminum or a polymer with an overcoating thickness from about 1 to 2 millimeters and is applied directly on the core 102 by spraying, dipping, powdered spraying, fluidized or any suitable technique. The dielectric coating may also be inorganic such as various oxide, flame spray coated and ceramics. Typical organic coatings include polyurethanes, polyesters, polytetra fluorethylenes, polycarbonates, and polyamides.

The electrode members 42 are preferably located on an outer periphery 110 of the dielectric layer 106. When the electrode members 42 are located on the outer periphery 42, as shown in FIG. 1, the electrode members 42 may be applied by any suitable method such as by silk screen printing or by photolithography. Due to the ability of photolithography to produce accurate electrode members, photolithography is well suited for application of the electrodes 42.

It should be appreciated that the electrodes may be formed in the dielectric layer 106 by first forming grooves (not shown) in the periphery 110 of the dielectric layer and subsequently filling the grooves with a conductive material to form the electrodes. The grooves may be formed by laser milling or any other suitable method. Grooves having a depth of about 25–50 microns have been found to perform effectively. The grooves could be filled by spraying, dipping, powdered spraying, fluidized or any suitable technique.

When located on an outer periphery 110, the electrode members 42 are typically 50 to 150 microns wide and approximately 10 microns deep. The spacing between adjacent electrode member 42 is approximately 150 microns.

The electrode members are formed from an electrically conductive material on the dielectric layer 106. The electrically conductive material forms the electrical conductors or electrode members 42. The electrical conductors 42 have electrical conductivity of about $10^{-3}$ ohms-centimeters. A suitable electrically conductive material is a silver conductive epoxy or paint. The conductive material can be applied by an angular meniscus coater or by any other suitable method so that isolated conductors 42 are created.

A charge relaxable layer 111 (see FIGS. 1 and 4) is applied over the dielectric layer 106 at the electrode members 42 to prevent electrical shorting between bias electrodes 112 and the common electrodes 114. The layer 111 has a thickness of about 25–35 microns, and has a conductivity chosen to allow dissipation of charge accumulation and permit penetration of fringe fields. The layer 111 can be spray or dip coated.

The donor roll 40 of FIG. 1 includes two distinct sets of electrode members 42. The first set includes the biased electrodes 112 which extend over the periphery 110 of the dielectric layer 106 of the donor roll 40 parallel to longitudinal axis 126 of the donor roll 40. AC and DC bias 96 and 97, respectively, are applied to the biased electrodes 112. The electrode members 42 also include a second set of electrodes which are preferably in the form of the common electrodes 114. The common electrodes 114 are equally spaced about the periphery 110 of the dielectric layer 106 of the roll 40 and are, like the biased electrodes 112, parallel to the axis 126 of the donor roll 40. The common electrodes 114 are preferably each spaced between two adjacent biased electrodes 112. The biased electrodes 112 and the common electrodes 114 form an interweaved or inter-digitated pattern about the periphery 110 of the dielectric layer 106 of the donor roll 40. The biased electrodes and the common electrodes are spaced approximately 0.15 millimeters apart and are approximately 10 microns deep. The AC and DC bias 96 and 97, respectively, is applied to the bias electrodes 112. The charge in the biased electrodes moves from the biased electrodes 112 through the dielectric layer 106 to the common electrodes 114. A powder cloud is formed in the development nip 98 or nip above the donor roll between the charged biased electrode 112 and the common electrode 114. While the invention may be practiced with as few as one biased electrode 112 being biased, preferably four electrodes are simultaneously charged in the nip 98 in order to form the powder cloud.

The donor roll 40 is preferably divided into three zones or areas. A central or developing area 130 at which the latent image is developed onto the substrate, a grounding area 150 where the common electrodes 114 are grounded, and a commutating area 140 where the biased electrodes 112 are commutated. In the developing area 130, the biased electrodes 112 and the common electrodes 114 extend axially along the donor roll 40. The powder cloud is formed in the development nip 98 in the developing area 130 of the donor roll 40. The developing area 130 of the donor roll 40 has a length L1 of approximately 270 millimeters which provides for a developed image width of approximately 11 inches. It should be appreciated that the invention may be practiced with a length L1 of the developing area larger and smaller depending upon the desired width of the developed image.

The commutating area 140 of the donor roll 40 provides an area for the commuting of the biased electrodes 112. To reduce the electrical stress on the biased electrodes 112 and the brush 99 when the brush 99 commutes with the electrodes 112, according to the present invention, the biased electrodes are interconnected. While the invention can be practiced with electrodes 112 being electrically interconnected in any suitable fashion, to simplify the construction of the donor roll and to minimize the electrical path within the electrodes 112, adjacent biased electrodes 112 are interconnected in the commutating zone.

For example, a first biased electrode 116 and a second biased electrode 118, which are adjacent to each other, are interconnected in the commutating area 140. A common electrode 114 is located between the first and second biased electrodes 116 and 118, respectively. While the first and second biased electrodes 116 and 118 may be interconnected in any suitable fashion, preferably, the first and second biased electrodes 116 and 118 are interconnected by a pad 120. The pad 120 may be made of any suitable electrically conductive material, such as a metal. Preferably, however, the pad 120 is made of the same material as the biased electrodes 112 and the common electrodes 114. The pads 120 are formed by any suitable method but, preferably, are formed on the periphery 110 of the dielectric layer 106 of the donor roll 40 by the same process in which the biased electrodes 112 and the common electrodes 114 are formed.

While the pads 120 may have any suitable shape, the pads 120 preferably have a generally rectangular and arcuate form having an arcuate width WP extending angularly about the periphery 110 of the dielectric layer 106 from the first biased electrode 116 to the second biased electrode 118. The width WP of the pad is approximately 500 microns. The pads 120 have a length LT which is slightly smaller than axial length L2 of the commuting area 140 of the donor roll 40. Donor rolls with a pad 120 having a length LT of approximately 19 millimeters have been found to perform satisfactorily.

The brush 99 closely conforms to the periphery 110 of the donor roll 40 and has a length LB approximately equal to the length LT of the pad 120. The brush 99 also has an arc width WB of approximately two and one half times the arc width WP of the pad 120. By providing a brush 99 with an arc width WP of approximately two and one half times the arc width WP of the pad at least two of the pads 120 are continually in contact with the brush 99. This configuration provides for at least four of the biased electrodes 112 being energized at any one time. It is found that four biased electrodes 112 being energized at one time provides for an optimum powder cloud. Further, the configuration of charging at least two pads 112 at any one time provides for a continual load upon the electrodes 112 of the donor roll 40 thus reducing the electrical stress upon the system. By providing the pads with a length LP a approximately equal to the axial length of the commutating area and providing for an arc width WP of pads at least as great as the distance between adjoining biased electrodes 112 provides for a significantly increased size of the effective contact surface between the brush 99 and the electrodes 112 greatly enhancing the ability to commutate and the resistance to abrasion between the brush 99 and the electrodes 112.

To provide for the application of AC and DC bias 96 and 97 respectively to the biased electrodes 112, the brush 99 is placed along the periphery 110 of the donor roll 40. Because the photoreceptor belt 10 is placed very close to the donor roll 40 at the nip 98 therebetween, it is impractical to place the brush 99 at the nip 98 under the photoreceptor 10. Therefore, the commutating area 130 of the donor roll 40 must either extend beyond an edge of the photoreceptor 10, or, conversely, the electrodes 112 in the commutating area 140 must extend in a spiral fashion to permit the commutation at an angular position different from the nip 98. It should be appreciated that any shape in which the electrodes 42 may extend around the periphery in a partially axially and a partially tangential direction in which the adjacent electrodes 112 do not contact or intersect would permit the commutating away from the nip 98.

The brush 99 may be made of any suitable durable material, but is preferably made of a synthetic material impregnated with carbon to provide conductivity. While common electrodes 114 and biased electrodes 112 are located in the developing area 130, it should be appreciated that in the commutating area 140 only the biased electrodes 112 are located.

The donor roll 40 further includes the grounding area 150 which extends from the developing area 130 opposite the commutating area 140. In the grounding area 150, only the common electrodes 114 are located. The common electrodes 114 extend parallel to the longitudinal axis 124 outwardly from the developing area 130. The common electrodes 114 are grounded in the grounding area 150 by any suitable method, such as by a grounding brush, not shown. The grounding area 150 has an axial length L3 of approximately 4 millimeters to provide ample contact to provide the grounding of the common electrodes 114.

Referring now to FIG. 1A, the brush 99 is shown in position contacting the pads 120 of the donor roll 40. The brush 99 is shown centrally in position over pad 120. The brush 99 is also shown in phantom at the respective edges of the pad 120. It is obvious from FIG. 1A that when the brush 99 has a width WB of two and one half times the width WP of the pad, at least two pads 120 are in contact with the brush 99 at all times.

Figure 2:
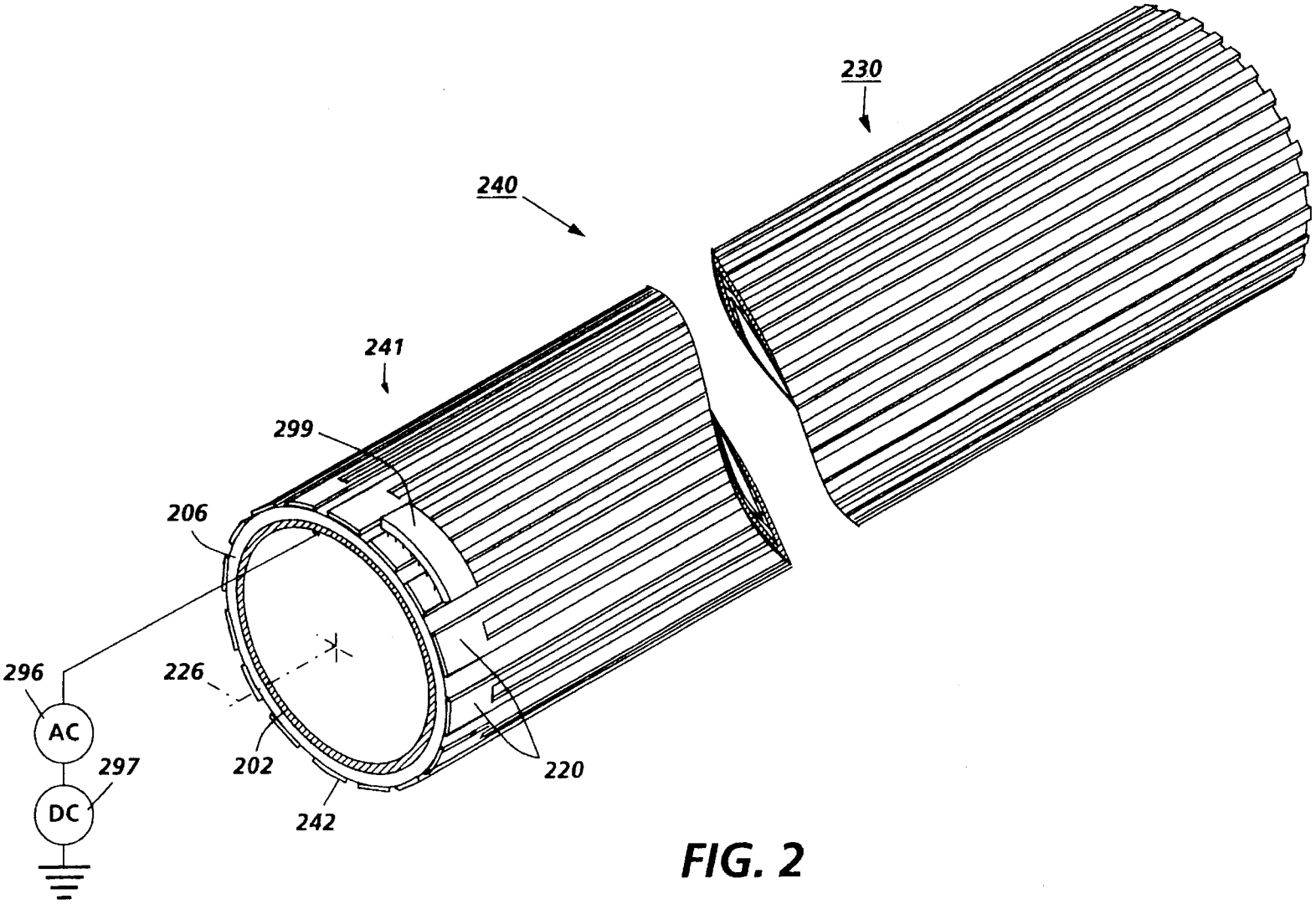
FIG. 2 is a fragmentary perspective view of an alternate embodiment of the dual commutation segmented donor roll of the present invention.

An alternate form of an electrode donor roll according to the present invention is shown in donor roll 240 of FIG. 2. Donor roll 240 is similar to donor roll 40 of FIG. 1, except that rather than having the common electrodes 114 of the donor roll 40, the donor roll 240 utilizes conductive core 202 to provide ground. The donor roll 240 includes electrodes 242 located on dielectric layer 206 of the donor roll 240. The electrodes 242 are similar in shape to the electrodes 42 of the donor roll 40. The AC and DC biases 296 and 297 pass from the electrodes 242 through the dielectric layer 206 to the conductive core 202. The powder cloud is formed when the electrodes 242 pass through the dielectric layer 206 between the electrodes 242 and the conductive core 202 charging the toner to form the toner cloud. The donor roll 240 includes a developing area 230 in which the latent image is developed. Extending from an end of the developing area 130 is the commutating area 241. The commutating area 241 includes pads 220 which extend between joining electrodes 242 and extend generally the axial length of the commuting area 241 of the donor roll 240. Brush 299 contacts at least two of the pads 220 at all times. The pads 220 are similar in shape and configuration to the pads 120 of the donor roll 40 of FIG. 1. The brush 299 of FIG. 2 is similar to the brush 99 of the donor roll 40 of FIG. 1.

The use of connecting biased electrodes provides for a reduction in the electrical stress of one half. Contact between the brush and the electrodes is interrupted only one half as often reducing the electrical stress by one half.

The use of interconnecting pads between adjacent biased electrodes of the donor rolls provides for a resulting increase in the effective commutating surface enhancing the ability of the brush to communicate with the electrodes and reducing the resistance of the brush and the electrodes to abrasion.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. An apparatus for transporting marking particles, comprising:

a donor roll;

an electrode member including a plurality of electrical conductors mounted on the surface of donor roll with adjacent electrical conductors being spaced from one another; and a plurality of spaced apart connecting members fixedly secured to said donor roll proximate a first end of said donor roll, each of said connecting members electrically interconnecting at least two electrical conductors, said connecting members being electrically isolated from each other.

2. An apparatus according to claim 1, wherein said electrode member comprises:

a first set of spaced apart electrical conductors; and a second set of spaced apart electrical conductors, each conductor of said second set of conductors being interposed between adjacent conductors of said first set of conductors.

3. An apparatus according to claim 2, wherein said connecting member electrically interconnects at least two adjacent electrical conductors of said first set of conductors.

4. An apparatus according to claim 3, wherein said connecting member comprises an electrically conductive pad electrically interconnecting two adjacent electrical conductors of said first set of conductors.

5. A developer unit for developing a latent image recorded on an image receiving member to form a developed image, said developer unit adaptable for use with a power source for providing an electrical bias to said developer unit, said developer unit comprising:

a donor roll;

an electrode member including a plurality of electrical conductors mounted on the surface of donor roll with adjacent electrical conductors being spaced from one another; and a plurality of spaced apart connecting members fixedly secured to said donor roll proximate a first end of said donor roll, each of said connecting members electrically interconnecting at least two electrical conductors, said connecting members being electrically isolated from each other so that said connecting members may selectively receive the electrical bias.

6. A developer unit according to claim 5, wherein said electrode member comprises:

a first set of spaced apart electrical conductors; and a second set of spaced apart electrical conductors, each conductor of said second set of conductors being interposed between adjacent conductors of said first set of conductors.

7. A developer unit according to claim 6, wherein said connecting member electrically interconnects at least two adjacent electrical conductors of said first set of conductors.

8. A developer unit according to claim 7, wherein said connecting member comprises an electrically conductive pad electrically interconnecting two adjacent electrical conductors of said first set of conductors.

9. A developer unit according to claim 5, further comprising means for electrically biasing said electrode member to detach toner from said donor member to form a cloud of toner in the space between said donor member and the surface with toner developing the image.

10. A developer unit according to claim 9, wherein said biasing means comprises:

a voltage source; and a brush, coupled to said voltage source, in contact with at least one of said plurality of electrical conductors.

11. An electrophotographic printing machine having a developer unit adapted to develop with marking particles an electrostatic latent image recorded on a photoconductive member, the machine comprising:

a donor roll;

an electrode member including a plurality of electrical conductors mounted on the surface of donor roll with adjacent electrical conductors being spaced from one another; and a plurality of spaced apart connecting members fixedly secured to said donor roll proximate a first end of said donor roll, each of said connecting members electrically interconnecting at least two electrical conductors, said connecting members being electrically isolated from each other so that said connecting members may selectively receive the electrical bias.

12. A printing machine according to claim 11, wherein said electrode member comprises:

a first set of spaced apart electrical conductors; and a second set of spaced apart electrical conductors, each conductor of said second set of conductors being interposed between adjacent conductors of said first set of conductors.

13. A printing machine according to claim 12, wherein said connecting member electrically interconnects at least two adjacent electrical conductors of said first set of conductors.

14. A printing machine according to claim 13, wherein said connecting member comprises an electrically conductive pad electrically interconnecting two adjacent electrical conductors of said first set of conductors.

15. A printing machine according to claim 11, further comprising means for electrically biasing said electrode member to detach toner from said donor member to form a cloud of toner in the space between said donor member and the surface with toner developing the image.

16. A printing machine according to claim 15, wherein said biasing means comprises:

a voltage source; and a brush, coupled to said voltage source, in contact with at least one of said plurality of electrical conductors.

* * * * *